United States Patent [19]

Nitta

[11] Patent Number: 4,878,836

[45] Date of Patent: Nov. 7, 1989

[54] GASLIGHTER STRUCTURE

[75] Inventor: Tomio Nitta, Yokohama, Japan

[73] Assignee: Tokai Corporation, Yokohama, Japan

[21] Appl. No.: 344,722

[22] Filed: Apr. 28, 1989

[30] Foreign Application Priority Data

May 11, 1988 [JP] Japan ..... 63-61049
May 11, 1988 [JP] Japan ..... 63-61050
May 11, 1988 [JP] Japan ..... 63-61051

[51] Int. Cl.[4] ..... F23Q 25/00

[52] U.S. Cl. ..... 431/277; 431/273; 431/274

[58] Field of Search ..... 431/135, 129, 146, 152, 431/144, 264, 274, 277, 273; 206/242

[56] References Cited

U.S. PATENT DOCUMENTS 2,529,094 11/1950 Miller ..... 431/277 X 2,618,953 11/1952 Florman ..... 431/152

*Primary Examiner*—Randall L. Green

*Attorney, Agent, or Firm*—Armstrong, Nikaido, Marmelstein, Kubovcik & Murray

[57] ABSTRACT

Disclosed is an improved gaslighter structure using a flint for striking flame. To facilitate the assembling work so as to permit automatic assembling, the gaslighter structure uses a mount which is designed to permit the assembling of parts into a flame-striking device and the connecting of the flame-striking device to related parts for synchronizing the flame-striking operation with the ejection of petroleum gas from the nozzle assembly by simply mounting the parts to the mount at selected portions. Then, the mount with the flame-striking device and associated parts is push-fitted to the lighter housing.

3 Claims, 2 Drawing Sheets

GASLIGHTER STRUCTURE

BACKGROUND OF THE INVENTION

1. Field of the Invention

The present invention relates to a gaslighter, particularly to an improved gas lighter structure which facilitates automatic mass production of gaslighters using flints for striking a flame.

2. Related Arts

In general, a gaslighter is composed of many small parts. Recently gaslighters show a tendency to be reduced in size and weight. Accordingly, the size of parts has been gradually reduced.

In assembling parts to form a gaslighter, a housing is hermetically closed with a top plate, and then a nozzle assembly is fixed to the top plate. At the same time, a flame-striking device and associated parts are built into a mount one after another. The mount bearing the flame-striking device is attached to the top plate of the housing. At that time the flame-striking device is connected to a thumb-operated cylinder in such a way that rotation of the thumb-operated cylinder can cause ignition of the tip of the nozzle assembly in synchronization with ejection of a flammable gas from the nozzle assembly.

The assembling work, however, is complicated because of the small size and number of parts. Particularly, the assembling and fixing of the flame-striking device requires skill and time.

SUMMARY OF THE INVENTION

In view of the above, one object of the present invention is to provide a gaslighter structure which permits necessary parts to be assembled into a flame-striking device with ease, and permits the flame-striking device to be push-fitted to a lighter housing, thereby improving the efficiency with which gaslighters are assembled.

To attain this object according to the present invention, first, the assemblies of a flame-striking device is performed by attaching necessary parts to a mount at selected positions, and then the mount with the flame-striking device thus built in, is push-fitted in the top plate of the lighter housing. This simplifies the assembly work, thus improving the efficiency with which the flame-striking device is built into the lighter housing.

Specifically, a gaslighter which the present invention relates to comprises: a lighter body comprising a housing having a built-in gas container to be filled with a liquefied petroleum gas, a nozzle assembly fixed to the top plate of said housing and cap pivot latch provided to the rear, top of said housing; a flint unit comprising a mount having a cover fitted thereon said cover having a flame aperture made in its front, a flint mechanism in the vicinity of said flame aperture and a conduit opening at the front end in the vicinity of said flame aperture, extending under said mount and connected at the rear end to said nozzle assembly; and a cap having a support piece at its rear end, said cap being fixed to said cap pivot latch to permit said cap to turn about its pivot and cover said flint unit when closed. According to the present invention this type of gaslighter is designed to use a mount which comprises a flat plateau and opposite walls integrally connected to the opposite longitudinal edges of said plateau in the form of the letter "U", each wall having at least one hook to be caught by said top plate of said housing.

According to one embodiment of the present invention a connector element is used to connect the rear end of the conduit to the nozzle assembly. The flat plateau of the mount has a notch to support the front end of the conduit, and also, it has an opening to permit insertion of the connector element. This arrangement permits automatic positioning of the front end of the conduit in the vicinity of the flame aperture, and at the same time, automatic connecting of the rear end of the conduit to the nozzle assembly without fail. This eliminates the necessity of the skill otherwise required for putting the fuel conduit end exactly within the sparking and igniting range from the flint and for connecting the fuel conduit with the tip of the nozzle assembly.

According to another embodiment of the present invention the flint mechanism includes a flint wheel which comprises a flint disc and two pivots extending from the center of the disc in opposite directions. The plateau has two vertically aligned slots to permit the pivots of the flint wheel to fit loosely, thereby allowing the flint wheel to rotate freely. This arrangement makes the aligning and connecting of a flint disc and a thumb-operated cylinder much easier than the vertical aligning and inserting of an elongated axle through these members, and the subsequent holding of the elongated axle at selected points.

Other objects and advantages of the present invention will be understood from the following description of a gaslighter according to the present invention, which is shown in the accompanying drawings.

BRIEF DESCRIPTION OF THE DRAWINGS

FIG. 4A is an exploded view of the gaslighter whereas

PREFERRED EMBODIMENT OF THE INVENTION

Figure 2:
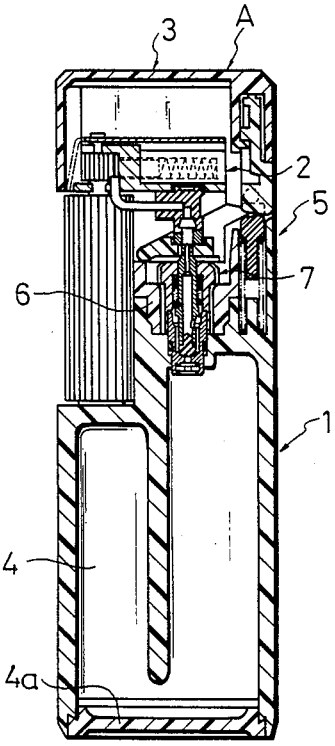
FIG. 2 is a longitudinal section of the gaslighter according to the present invention.

FIG. 2 shows a gaslighter A according to one embodiment of the present invention as comprising a lighter body 1, a flint unit 2 and a cap 3. The lighter body 1 is of a synthetic resin mold, comprising a gas container 4 to be filled with a liquefied petroleum gas, a nozzle assembly 7 fixed to the top plate 6 of the housing and a cap pivot latch 5 provided to the rear, top of the housing. The housing 1 has a bottom plate 4*a*.

Figure 4A:
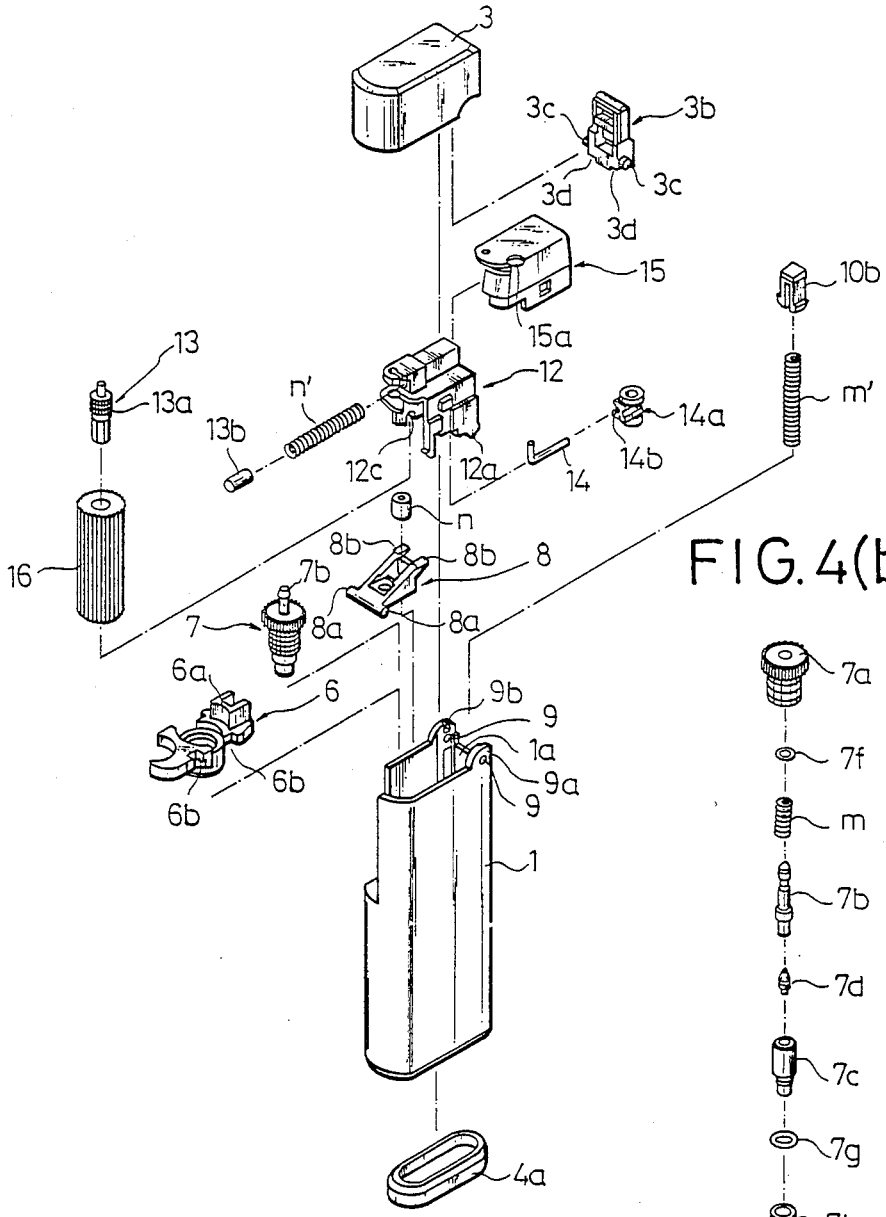
Figure 4B:
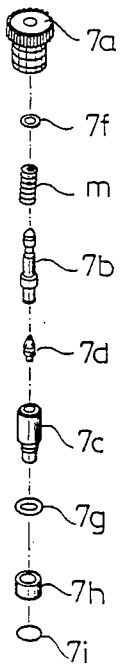
FIG. 4B is an exploded view of a nozzle assembly.

As best shown in FIG. 4B, the nozzle assembly 7 comprises an outer casing 7*a*, a tapped O-ring 7*f*, a spring (m), a gas ejection pipe 7*b*, a rubber plug 7*d*, an inner cylinder 7*c*, an O-ring 7*g*, a thermal adhesion pipe 7*h* and a filter 7*i*. The gas ejection pipe 7*b* is movably fitted in the outer casing 7*a* and partly appearing above the outer casing 7*a*. The nozzle assembly 7 is fixed to the top plate 6. Its outer casing 7*a*, is threadedly engaged with the tapped aperture of the top plate 6, and its inner cylinder 7*c* communicates with the inside of the gas container 4. The gas injection pipe 7*b* is biased downwards by the spring (m) to keep the rubber plug 7*d* closing the bottom aperture 7*e* of the inner cylinder 7*c*.

A lever 8 looks like a gun carriage. It has two pivot pins 8a integrally connected to the opposite sides of its front end, two engagement pieces 8b integrally connected to its rear, upper end, and an aperture in its bottom. The top end of the ejection nozzle 7b is inserted in the aperture of the lever 8, and is fixed to the lever 8 by a rubber ring (n).

A cap pivot latch 5 is provided to the rear, top of the housing 1.

The housing has two opposing elongations 9a integrally connected to its rear, top portion. Each elongation, somewhat flexible, has a through aperture 9 has a notch 9b inside. Each notch extends from the top end of the elongation, and it reaches short of the aperture 9. The support piece 3b is push-fitted into the rear space of the cap 3, and then the support piece 3b is pivotally fixed to the rear elongations 9a as later described.

The cap pivot latch 5 comprises a push rod 10b and an associated spring (m') in the hollow cylinder space 10a which is defined by the inner wall 1a of the rear portion of the housing and the rear wall 6a of the top plate 6. The push rod 10b is generally in the form of the letter "E", comprising a central leg and two opposite side legs and a horizontal base having an inclined top, all legs being integrally connected to the horizontal base. Each side leg has a hook 10c integrally connected to its side, and the spring (m') is loosely fitted around the central leg. The push rod 10b is spring-biased upwards to push itself against the support piece 3b of the cap 3, thereby permitting the cap 3 to click shut and open.

The flint unit 2 comprises a mount 12 having a cover 15 fitted thereon, a flint mechanism 13 arranged in the vicinity of the flame aperture 15a of the cover 15, and a conduit 14 opening at the front end in the vicinity of the flame aperture 15a, extending under the amount 12 and connected at the rear end to the gas ejection pipe 7b of the nozzle assembly 7 via a connecting piece 14a.

Figure 1:
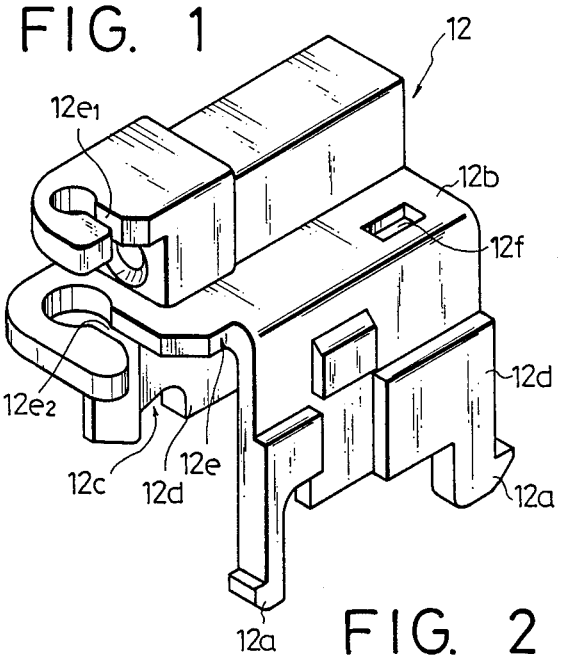
FIG. 1 is an enlarged perspective view of a amount which is used in fixing a flame-striking device and associated parts according to the present invention.
Figure 3:
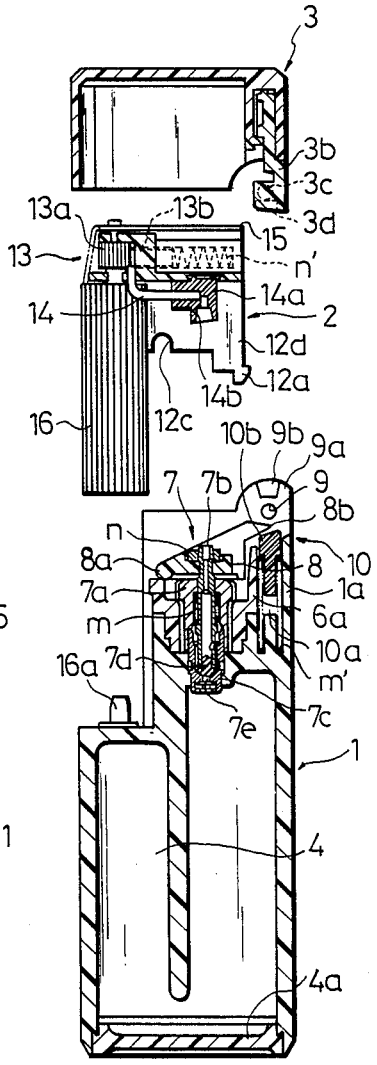
FIG. 3 is another longitudinal section of the gaslighter according to the present invention, showing a body, a flint unit and a cap separating from each other.

The mount 12 is a synthetic resin mold having a generally "U"-shape. Referring to FIG. 1, the mount 12 comprises a flat plateau 12b and opposite walls 12d integrally connected to the opposite longitudinal edges of the plateau 12b in the form of the letter "U". Each wall has hooks 12a to be caught by the notches 6 of the top plate 6 of the housing 1. As shown in FIG. 1, the flat plateau may have a notch 12e to support the front end of the conduit 14, and an opening 12f to permit insertion of the connecting piece 14a.

The mount 12 has two semicircular recesses 12b on its lower front edge. The lever 8 is rotatably fixed to the mount 12 with its pivot pins 8a in the semicircular recess 12b of the mount 12. The ejection nozzle 7b is fixed to the lever 8 as described earlier. When the lever 8 is pushed down to rotate about its pivot 8a, the ejection nozzle 7b is raised to permit ejection of gas from the nozzle point. The cover 15 is put on the mount 12 with its flame aperture 15a close to the front end of the L-shaped conduit 14. The rear end of the conduit 14 is inserted in the through hole 14b of the connector metal 14a, and the tip end of the ejection nozzle 7b is inserted in the through hole 14b.

The flint mechanism 13 comprises a flint wheel 13a and a flint 13b. The flint wheel comprises a flint disc 13a and two pivots 13c extending from the center of the disc in the opposite directions. Then, the plateau 12 has two slots $12e_1$ and $12e_2$ aligned vertically to permit the pivots 13c of the flint wheel to loosely fit, thereby allowing the flint wheel to rotate freely. Thus, the flint wheel 13a is located in the vicinity of the flame aperture 15a of the cover 15 when the cover 15 is put on the mount 12. The flint 13b is biased by a spring (n') to be pushed against the flint disc 13a all the time.

A rotatable cylinder 16 is connected to the flint wheel 13a. Rotation of the rotatable cylinder 16 causes the flint disc 13a to rotate for striking fire, thereby igniting the tip end of the conduit 14 when the gas ejects.

The fling unit 2 is made up by the mount 12 with its cover 15 put thereon, the flint mechanism located near the flame aperture 15a of the cover 15 and the conduit 14 opening at its front end near the flame aperture 15a, and extending under the mount 12. The flint unit 2 is push-fitted in the top space of the housing until the hooks 12a of the mount 12 are caught by the notches 6b of the top plate 6. At the same time, the lower axle 13c of the flint disc is inserted into the countersink made in the top end of the rotatable cylinder 16, and a pin 16a standing upright on the shoulder of the housing 1 is loosely inserted in the countersink made in the bottom of the rotatable cylinder 16. Thus, the rotatable cylinder 16 is rotatably fixed to the gaslighter body 1.

The upper elongation of the support piece 3b is push-fitted and fixed to the rear side of the cap 3 as best seen in FIG. 2. The opposite projections 3c of the support piece 3b are inserted in the slots 9b of the rear elongations 9a of the housing 1. The rear elongations 9a will be yieldingly bent outwards to allow the pivot axles 3c to go to and fall in the apertures 9 of the rear elongations 9a. Then, the bottom of the support piece 3b sits on the inclined top of the push rod 10b. Thus, the cap 3 is pivotally fixed to the housing 1.

The support piece 3b has engagement notches 3d on its bottom to catch the rear extensions 8b of the lever 8 for turning the lever 8 when the cap 3 opens.

As described above, a gaslighter structure according to the present invention uses a mount which is designed to permit the assembling of parts into a flame-striking device and the connecting of the flame-striking device to related parts for synchronizing the flame-striking operation with the ejection of petroleum gas from the nozzle assembly by simply mounting the parts to the mount at selected portions. Then, the mount with the flame-striking device and associated parts is push-fitted to the lighter housing. The use of such a mount facilitates the assembling work so as to permit automatic assembling. This expands the range of possibilities for automatic assembling of gaslighters.

I claim:

1. A gaslighter which comprises: a lighter body comprising a housing having a built-in gas container to be filled with a liquefied petroleum gas, a nozzle assembly fixed to a top plate of said housing and a cap pivot latch provided to the rear top of said housing; a flint unit comprising a mount having a cover fitted thereon, said cover having a flame aperture made in the front, a flint mechanism in the vicinity of said flame aperture and a conduit opening at the front end in the vicinity of said flame aperture, extending under said mount and connected at the rear end to said nozzle assembly; and a cap having a support piece at the rear end, said cap being fixed to said cap pivot latch to permit said cap to turn about its pivot and cover said flint unit when closed, characterized in that said mount comprises a flat plateau and opposite walls integrally connected to the opposite longitudinal edges of said plateau in the form of the letter "U", each wall having at least one hook to be caught by said top plate of said housing.

2. A gaslighter according to claim 1 wherein it further comprises a connector element to connect the rear end of said conduit to said nozzle assembly, said flat plateau having a notch to support the front end of said conduit, and an opening to permit insertion of said connector element.

3. A gaslighter according to claim 1 or 2 wherein said flint mechanism including a flint wheel which comprises a flint disc and two pivots extending from the center of said disc in the opposite directions, said plateau having two slots aligned vertically to permit said pivots of said flint wheel to loosely fit, thereby allowing said flint wheel to rotate freely.

* * * * *